US005157927A

United States Patent [19]

Darchis et al.

[11] Patent Number: 5,157,927

[45] Date of Patent: Oct. 27, 1992

[54] PROCESS AND APPARATUS FOR THE PRODUCTION OF GASEOUS NITROGEN AND SYSTEM FOR SUPPLYING CORRESPONDING NITROGEN

[75] Inventors: Francois Darchis, Walnut Creek, Calif.; Francois Venet, Paris, France; Jean-Louis Girault, Liege, France; Maurice Grenier, Paris, France; Patrick Jozon, Levallois Perret, France

[73] Assignee: L'Air Liquide, Societe Anonyme pour L'Etude et L'Exploitation des Procedes Georges Claude, Paris, France

[21] Appl. No.: 673,518

[22] Filed: Mar. 22, 1991

[30] Foreign Application Priority Data

Apr. 10, 1990 [FR] France ..... 90 04566

[51] Int. Cl.[5] ..... F25J 3/00

[52] U.S. Cl. ..... 62/37; 62/40

[58] Field of Search ..... 62/9, 40, 37

[56] References Cited

U.S. PATENT DOCUMENTS 4,668,260 5/1987 Yoshino ..... 62/40
4,698,079 10/1987 Yoshino ..... 62/40
4,853,015 8/1989 Yoshino ..... 62/40

FOREIGN PATENT DOCUMENTS 0190355 1/1986 European Pat. Off. .
2225705 11/1974 France .

*Primary Examiner*—Ronald C. Capossela
*Attorney, Agent, or Firm*—Young & Thompson

[57] ABSTRACT

As soon as the apparatus is started, a flow of liquid nitrogen which is at least equal to the nominal flow of gaseous nitrogen is introduced in the head portion of the column, then the flow of liquid nitrogen is adjusted to a small fraction of this nominal flow. Application to the production of a flow of gaseous nitrogen which is variable and moderate.

13 Claims, 2 Drawing Sheets

PROCESS AND APPARATUS FOR THE PRODUCTION OF GASEOUS NITROGEN AND SYSTEM FOR SUPPLYING CORRESPONDING NITROGEN

BACKGROUND OF THE INVENTION (a) Field of the Invention

The present invention relates to the production of gaseous nitrogen. It is more particularly concerned with satisfying moderate (typically 100 to 1000 $Nm^3/h$) and variable needs in nitrogen of high purity, i.e. typically containing less than 0.1% oxygen. In the present description, the flows under consideration are expressed in weight.

(b) Description of the Prior Art

High purity nitrogen is normally obtained by cryogenic means. For small consumptions, the construction of a self-contained known production unit represents a prohibitive investment, in the case of automated installations, and a more limited investment but with high labor expenses in the opposite case which always represents a high cost for the nitrogen produced.

A more economical solution consists in utilizing an evaporator, i.e. a container for liquid nitrogen with large capacity, for example many tens of thousands of liters, from which liquid nitrogen is withdrawn and vaporized. This solution is not very satisfactory from on an energy point of view, because the frigorific energy contained in liquid nitrogen is lost, and, in addition, it requires the presence, at a relatively small distance, of a unit for the production of liquid nitrogen, so that the cost of supplying the evaporator with a tank-truck remains moderate.

SUMMARY OF THE INVENTION

The invention aims at providing a technology enabling to produce variable and moderate quantities of gaseous nitrogen at reduced cost, and at increased distances from a unit for the production of liquid nitrogen.

For this purpose, the invention aims at a process for the production of gaseous nitrogen with a variable flow by means of an apparatus for air distillation comprising a column for air distillation of the type HPN which is adapted to produce a nominal flow of gaseous nitrogen and having a head connected to a source of liquid nitrogen, characterized by the fact that as soon as the apparatus is started, a flow of liquid nitrogen which is at least equal to the nominal flow of gaseous nitrogen is introduced into the head portion of the column, after which the flow of liquid nitrogen is adjusted to a small fraction of this nominal flow.

In the present description, the term "column for the distillation of air of the HPN type" means a simple distillation column provided with a head condenser. In such a column, the air to be treated, compressed under a pressure of the order of 6 to 12 bars, from which water and $CO_2$ have been removed and cooled to the vicinity of its dew point, is introduced at the base of the column. The "rich liquid" (oxygen enriched air) collected in the vat portion of the column is expanded and vaporized in the head condenser, after which it is removed as a residue. The gaseous nitrogen produced is withdrawn from the head portion of the column.

According to advantageous characteristics of the invention:

said nominal flow is introduced during a period of time at least equal to a predetermined length of time which is sufficient to ensure a predetermined level of refrigerating liquid in the head condenser of the column;

to produce a flow of gaseous nitrogen which is higher than the nominal flow, a flow of make-up liquid nitrogen originating from said source is vaporized outside the column;

at least a portion of the make-up flow is vaporized by heat exchange with the incoming air upstream of the inlet of this air in the compressor of the apparatus.

It is also an object of the invention to provide an apparatus for the production of gaseous nitrogen with variable flow, adapted for the operation of such process. This apparatus, of the type comprising an air distillation column of the HPN type and a container for liquid nitrogen connected by means of a duct of liquid to the head portion of the column, is characterized in that said duct is provided with flow control means adapted on the one hand for allowing a substantial flow of liquid, at least equal to the nominal flow of gaseous nitrogen in the column to pass therethrough, on the other hand to adjust the flow of liquid with reference to a mean value equal to a small fraction of this nominal flow.

It is also an object of the present invention to provide a system for supplying gaseous nitrogen to a plurality of users, this system comprising :

a unit for the production of liquid nitrogen;

at least one tank-truck;

in a first radius around the production unit, a series of liquid nitrogen vaporizers which can be supplied by the tank-truck;

between the first radius and the second radius, which second radius is greater than the first, a series of apparatuses as defined above, wherein the container of these installations can be supplied by the tank-truck.

An embodiment of the invention will now be described with reference to the annexed drawings, in which.

DESCRIPTION OF PREFERRED EMBODIMENTS

Figure 1:
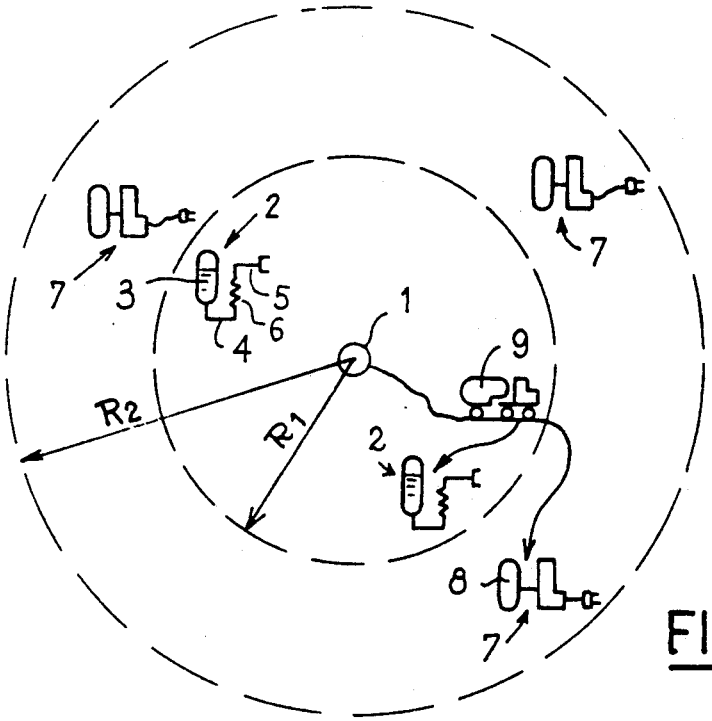
FIG. 1 is a schematic illustration of a system for the production of gaseous nitrogen according to the invention.
Figure 2:
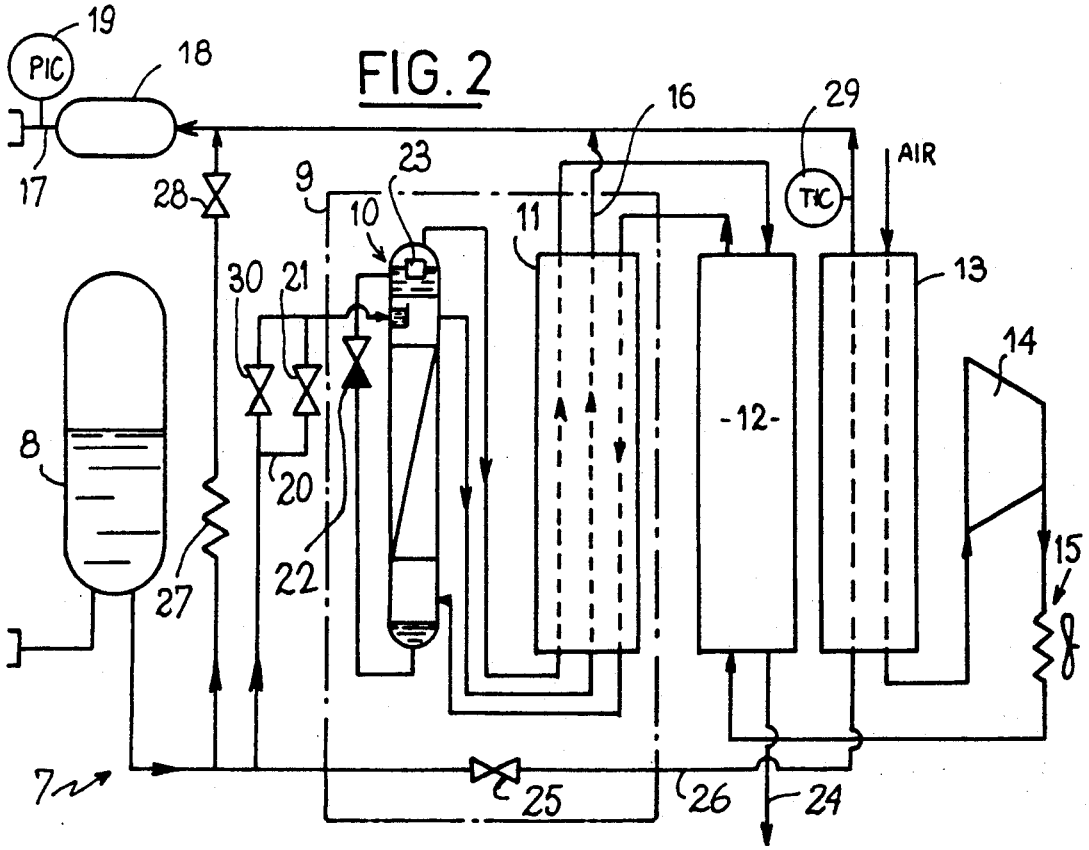
FIG. 2 is a schematic representation of an apparatus according to the invention.

The system for supplying gaseous nitrogen represented in FIG. 1 essentially comprises:

a unit 1 for the production of liquid nitrogen;

within a radius R1 around this unit, a certain number of liquid nitrogen vaporizers 2, each consisting of a liquid nitrogen storage 3 of large capacity provided with a liquid withdrawing duct 4 connected to a utilization duct 5 via vaporizer 6, for example of the atmospheric type. Such vaporizers are well known in the art;

between radius R1 and radius R2>R1 around unit 1, a certain number of apparatuses 7 such as those of FIG. 2, each of these apparatuses comprising a container for liquid nitrogen 8;

at least one tank-truck 9, and generally a fleet of such trucks, adapted to supply the vaporizers 2 and containers 8 of the apparatuses 7 with liquid nitrogen produced by unit 1; and possibly a teletransmission system (not represented) connecting each vaporizer 2 and each apparatus 7 to unit 1 to ensure the management of the deliveries of liquid nitrogen by the tank-truck(s).

The apparatus 7 represented in FIG. 2 essentially comprises:

the above-mentioned container 8;

a cold box 9 containing on the one hand an air distillation column 10 of the type HPN (High Purity Nitrogen), on the other hand a heat exchange line 11;

a device 12 for purifying air by adsorption;

an auxiliary heat exchanger 13;

an air compressor 14; and an air refrigerating device 15.

The operation of apparatus 7 will now be described with reference to FIGS. 2 and 3. On the diagram of FIG. 3 the time t has been shown on the abscissae, and a plurality of parameters, whose meaning will appear hereinbelow, are given as ordinates.

The first description will be the novel operation of the apparatus, i.e. at permanent rate where column 10 via withdrawing duct 16, exiting from the head portion of the column, produces a constant flow of gaseous nitrogen which is equal to the nominal flow DN for which the column has been designed. Duct 16 ends in a utilization duct 17 provided with a buffer capacity 18 and, downstream of the latter, a pressure pick-up 19.

Figure 3:
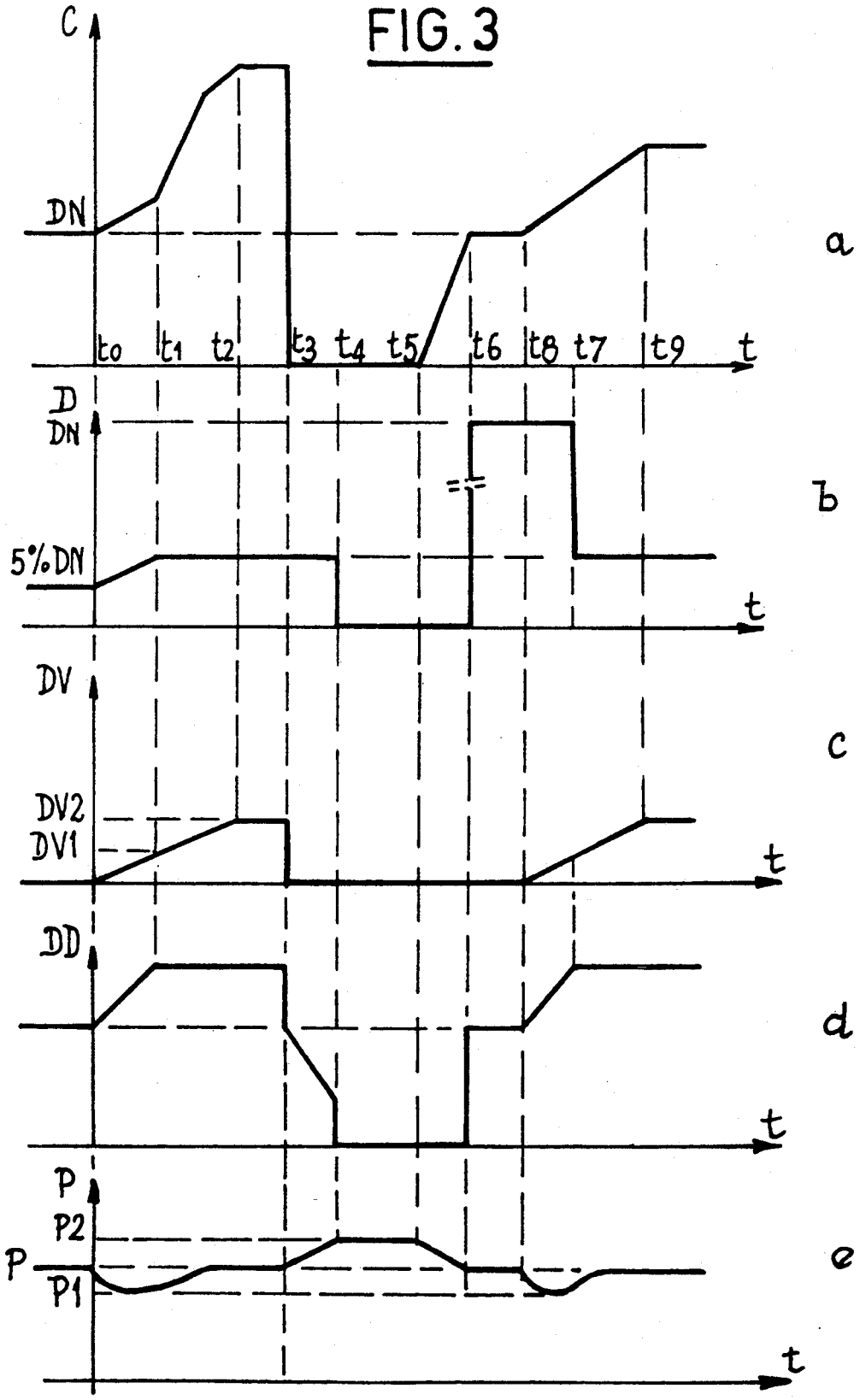
FIG. 3 is a diagram illustrating the process according to the invention.

In this operation (corresponding to $t<tO$ on FIG. 3), the nitrogen consumption C (FIG. 3(*a*)) is constant and equal to the nominal flow DN, and the pick-up 19 indicates a constant pressure P (FIG. 3(*e*)). Via a duct 20 provided with an electromagnetic valve 21 for any kind of adjustment, a mean to small flow of liquid nitrogen, for example equal to about 5% DN (FIG. 3(*b*)), is introduced in the head portion of the column 10 and serves to ensure that cold conditions are maintained and also to increase the rate of reflux of the column. The heat exchanger 13 is inactive. The entering air compressed by compressor 14, precooled by air cooling device 15, purified in a device 12 and cooled to the vicinity of its dew point in exchange line 11, is introduced at the bottom of column 10. The rich liquid collected in the vat portion of the column is expanded in an expansion valve 22, vaporized in the head condenser 23 of the column, warmed with countercurrent air in the heat exchanger 11, then used to regenerate device 12 before being withdrawn via duct 24 as residual gas of the apparatus.

It will be presumed that at instant t0, the consumption (or demand) of gaseous nitrogen starts to increase (FIG.3(*a*)). The pressure at 19 decreases (FIG.3(*e*), which provokes the opening of a valve 25 provided along a duct 26 which connects the bottom of container 8 to the cold end of exchanger 13. A flow DV1 of nitrogen (FIG. 3(*c*)) is thus vaporized by cooling with countercurrent entering air to a moderate temperature, for example, of the order of −20° C., then this gaseous nitrogen is sent to a reservoir 18. Following this, the compressor sucks an increased mass flow of air and the production DF (distilled flow) of the column increases (FIG. 3(*d*)). Simultaneously, the flow of liquid nitrogen which is introduced through duct 20 increases to some extent (FIG. 3(*b*)), to keep the level of rich liquid constant in the condenser 23.

If, from t1 to t2, the consumption continues to increase (FIG. 3(*a*)), an additional vaporization of liquid nitrogen (FIG. 3(*c*)) is carried out in an auxiliary vaporizer 27 as a result of the opening of a valve 28 without modifying the flow produced by distillation (FIG. 3(*d*)), after which this gaseous nitrogen is also sent to the reservoir 19. This opening of the valve 28 takes place when the pressure reaches a low value Pl (FIG. 3(*e*)). The total vaporized flow DV2, which is the sum of the flows vaporized in the exchanger 13 and in vaporizer 27, corresponds to the make-up nitrogen required to satisfy the demand. This vaporization of liquid nitrogen brings back the pressure at 19 to nominal value P (FIG. 3(*e*)).

It should be noted that after a certain period of time, frost may start to form in the exchanger 13. This is detected by a temperature detector 29 which is disposed at the nitrogen outlet of this exchanger and closes valve 25.

After a phase of stabilization (from t2 to t3), when consumption decreases, the pressure at 19 increases, which provokes a stop of the vaporization of nitrogen (closing of valves 25 and 28), then, when the pressure reaches a high value P2, the apparatus is stopped, for example through compressor 14 (instant t4).

When the consumption of gaseous nitrogen resumes (instant t5), the pressure decreases, and when it reaches nominal value P1 (instant t6), a self-starting electromagnetic valve 30 mounted as a bypass of the electromagnetic valve 21 and normally closed, is opened. This electromagnetic valve 30 is such that, in opened position, it allows for the passage of a flow of liquid nitrogen which is at least equal to the nominal flow DN. Its closing takes place when two conditions are fulfilled:

(*a*) a predetermined time T has passed since its opening; and (*b*) the level of rich liquid in condenser 23 is at least equal to a predetermined value.

Time T is determined so as to ensure that, whatever the condition, hot or cold, of the apparatus when starting same, cold conditions and the correct charge of liquid at each level of a column are obtained. It is possible, for example, to select a time T of the order of 2 minutes.

The electromagnetic valve 30 thus closes at instant t7 indicated on FIG. 3.

FIG. 3 also represents instant $t8<t7$ and $t9>t7$ for which, respectively, the consumption C increases beyond the nominal value after which it stabilizes, the same phenomena as described above being then automatically reproduced (vaporization of nitrogen and variations of the pressure and the flow of nitrogen produced by the column).

It will therefore be seen that the apparatus can very easily operate entirely automatically in spite of a structure and automatisation means which are very inexpensive. In particular, as soon as the apparatus is started, a flow of nitrogen at least equal to the demand is vaporized in the column, which simultaneously ensures the necessary cold input and the production of required gaseous nitrogen, and moreover prevents the entering air from rising in the column. After this, the nitrogen introduced into the reservoir 18 has immediately the required purity.

As a variant, the two electromagnetic valves 21 and 30 may be replaced by a single cryogenic valve with variable flow.

It will be noted that for proper operation, the apparatus needs only one electrical connection, which has been illustrated symbolically on FIG. 1.

We claim:

1. A method of producing gaseous nitrogen at variable flow rates by means of air distillation using an HPN air-separation column for producing gaseous nitrogen product and having a head portion and a bottom portion which is fed with compressed air, and wherein liquid nitrogen storage means supplies a flow of liquid nitrogen to the head of the column, and wherein a nominal flow of liquid nitrogen from the storage means is supplied to the head of the column after the column rouses a nominal flow of gaseous nitrogen; the improvement comprising sensing the pressure of said gaseous nitrogen product, and selectively modulating the flow of liquid nitrogen supplied from the storage means to the head of the column in a range above said nominal flow of liquid nitrogen in dependence on the sensed pressure, to accommodate variations in the demand for gaseous nitrogen.

2. The method of claim 1, comprising increasing the flow of liquid nitrogen supplied from the storage means to the head of the column when the sensed pressure decreases as a result of an increase in the demand of gaseous nitrogen.

3. The method of claim 2, further comprising the step of selectively withdrawing an additional flow of liquid nitrogen from the storage means in dependence of the sensed pressure, and vaporizing said additional flow for addition, in the product line, to the flow of gaseous nitrogen from the column to meet a substantial increase in the demand of gaseous nitrogen.

4. The method of claim 3, wherein said additional flow of liquid nitrogen is vaporized at least part by heat-exchange with feed air supplied to the column.

5. The method of claim 3, wherein said additional flow of liquid nitrogen is further vaporized at least part in an auxiliary heat exchanger.

6. The method of claim 2, wherein said nominal flow of liquid nitrogen supplied from the storage means to the column corresponds to about 5% by weight of the nominal flow of gaseous nitrogen produced by the column.

7. Apparatus for the production of gaseous nitrogen at variable flow rates by means of air distillation, comprising an HPN air-separation column for producing gaseous nitrogen product and having a head portion and a bottom portion which is fed with compressed air, and liquid nitrogen storage means supplying a flow of liquid nitrogen to the head of the column, and means to supply a nominal flow of liquid nitrogen from the storage means to the head o the column after the column produces a nominal flow of gaseous nitrogen; the improvement comprising means for sensing the pressure of said gaseous nitrogen product, and means for selectively modulating the flow of liquid nitrogen supplied from the storage means to the head of the column in a range above said nominal flow of liquid nitrogen in dependence on the sensed pressure, to accommodate variations in the demand for gaseous nitrogen.

8. Apparatus for the production of gaseous nitrogen at variable flow rates, comprising:

an air distillation column having a head portion with a gaseous nitrogen outlet discharging into a product line, a liquid nitrogen inlet, and a bottom portion with a feed air inlet;

a pressure sensor in the product line, furnishing a pressure signal;

air feeding means for feeding air to the feed air inlet via a feed air line including a compressor;

a liquid nitrogen storage means having an outlet, and a first liquid nitrogen line between the outlet of the storage means and the liquid nitrogen inlet of the column and including flow control means responsive to the pressure signal.

9. The apparatus of claim 8, wherein said flow control means comprises first and second control valves arranged in parallel in a branched portion of the first liquid nitrogen line.

10. The apparatus of claim 8, further comprising a first head exchange means through which passes said feed air line and further comprising a second liquid nitrogen line between the outlet of the storage means and the product line, the second liquid nitrogen line passing through the first heat exchange means and having a third control valve responsive to said pressure signal.

11. The apparatus of claim 10, wherein said first heat exchange means is coupled to said feed air line upstream of said compressor.

12. The apparatus of claim 10, further comprising a third liquid nitrogen line between the outlet of the storage means and the product line, including a vaporizer and a fourth control valve responsive to said pressure signal.

13. A network for in situ supply of gaseous nitrogen to at least two remote users, comprising:

a central unit for the production of large quantities of liquid nitrogen;

at least one tank truck for remote dispatch of liquid nitrogen produced at the central unit;

within a first radius around the central unit, at least a vaporizing unit for vaporizing liquid nitrogen, having a liquid nitrogen tank for supplying gaseous nitrogen to a first user;

within a range between the first radius and a second radius greater than the first radius, at least an apparatus for the production of aseous nitrogen at variable flow rates, for supplying gaseous nitrogen to a second user, the latter apparatus comprising:

an air distillation column having a head portion with a gaseous nitrogen outlet discharging into a product line, a liquid nitrogen inlet, and a bottom portion with a feed air inlet;

a pressure sensor in the product line, furnishing a pressure signal;

air feeding means for feeding air to the feed air inlet via a feed air line including a compressor;

a liquid nitrogen storage means having an outlet, and a first liquid nitrogen line between the outlet of the storage means nd the liquid nitrogen inlet of the column and including flow control means responsive to said pressure signal, whereby the liquid nitrogen tank of the vaporizing unit and the liquid nitrogen storage means of the apparatus are periodically refilled from the central unit by the tank truck with liquid nitrogen.

* * * * *